United States Patent [19]

Ehrhart

[11] 4,313,042

[45] Jan. 26, 1982

[54] CORROSION INDICATOR

[76] Inventor: Dale L. Ehrhart, 819 Bonifant St., Silver Spring, Md. 20910

[21] Appl. No.: 84,665

[22] Filed: Oct. 15, 1979

[51] Int. Cl.[3] ..... H01H 29/00; G08B 17/02

[52] U.S. Cl. ..... 200/61.04; 340/590

[58] Field of Search ..... 200/61.04, 61.05, 61.08, 200/300; 340/590, 604, 605, 652; 123/41.15

[56] References Cited

U.S. PATENT DOCUMENTS

| | | | |
|---|---|---|---|
| 3,073,162 | 1/1963 | Ulanet | 200/61.04 X |
| 3,546,690 | 12/1970 | Kalert, Jr. | 200/61.04 X |
| 3,567,880 | 3/1971 | Palmer et al. | 200/61.08 |
| 3,720,797 | 3/1973 | Gunn et al. | 200/61.08 |
| 3,787,650 | 1/1974 | Lewis | 200/61.04 |
| 4,147,596 | 4/1979 | Baboian et al. | 340/59 X |

*Primary Examiner*—James R. Scott
*Attorney, Agent, or Firm*—H. Walter Clum

[57] ABSTRACT

In fluid flow systems corrosion of the fluid flow passages occur as a result of the action of the fluid on the passage walls as it flows through the system. The present invention provides a corrosion indicator for use in such systems and which includes among other things a novel switch having a member which is responsive to a corrosive condition within the system to self-destruct thereby to cause actuation of a signal to indicate the condition at a time to alert the user that remedial attention to the system is necessary.

6 Claims, 9 Drawing Figures

CORROSION INDICATOR

BACKGROUND OF THE INVENTION

1. Field of the Invention

The present invention relates to corrosion indicators but more specifically to corrosion responsive switches for use in fluid flow systems whereby a corrosive condition of, and effect of the fluid on the fluid flow passages of the systems may be detected and indicated.

2. Description of the Prior Art

Expensive and complicated corrosion indicating systems are used in commercial fluid flow systems. So far as known these systems employ the electrical conductivity of the fluid in the systems to activate indicators, such as meters or recording devices. No other prior art relating specifically to the present invention is known.

SUMMARY OF THE INVENTION

It is the principal object of the invention to provide a novel and inexpensive system for detecting and indicating corrosive conditions in fluid flow systems.

Another object of the invention is to provide a novel switching circuit for use in fluid flow systems enabling the detection and indication of corrosive conditions of the fluid in such systems.

More specifically, it is an object of the invention to provide a novel switch which is particularly, but not exclusively, useful in solar heating systems, and which has a part responsive to a corrosive condition in the system to self-destruct thus enabling associated signal means to be actuated to indicate the condition.

According to the above and other objects of the invention to be described hereinafter in greater detail, there is provided a signal system including a novel switch assembly for use in fluid flow systems for detecting a corrosive causing condition of the fluid in the system, said switch having electrical switch contacts normally contained in one of two conditions, open or closed, but held in its other condition by means responsive to corrosion in the system to self-destruct, thus permitting the switch contacts to be returned to their said normal condition whereby a signal in the system may be actuated to indicate the corrosive condition.

BRIEF DESCRIPTION OF THE DRAWINGS

The foregoing and other objects and advantages of the invention and its mode of operation will become apparent from the detailed description of the accompanying drawings, in which.

DESCRIPTION OF THE PREFERRED EMBODIMENT

Figure 1:
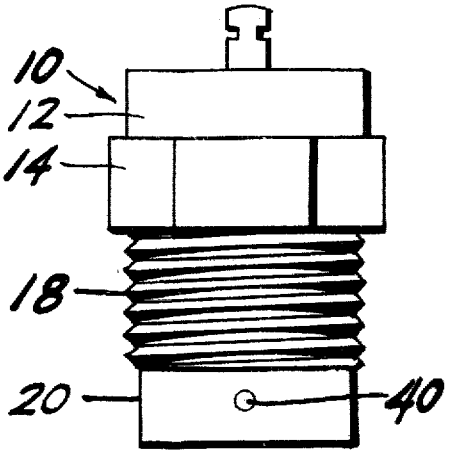
FIG. 1 is an elevational view of the novel switch of the invention.

First with reference to FIG. 1, it is seen that the novel switch of the invention, generally indicated by the numeral 10, is housed in a tubular sleeve 12 formed of some suitable corrosive resistent material, such as polyvinylchloride, commonly, and hereinafter referred to in this description as PVC. Sleeve 12 is provided with an integral nut shaped portion 14 spaced below the top thereof, enabling the switch to be fitted into a fluid flow system, as described more fully hereinafter, by the threads 18 beneath the nut portion and below which extends the lower end portion 20 of the sleeve.

Figure 2:
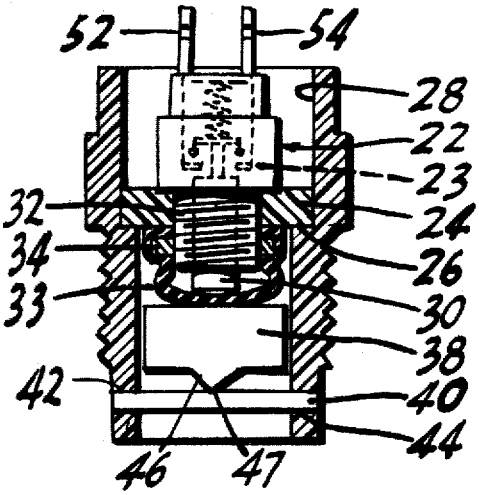
FIG. 2 is a sectional view taken through the center of FIG. 1.
Figure 3:
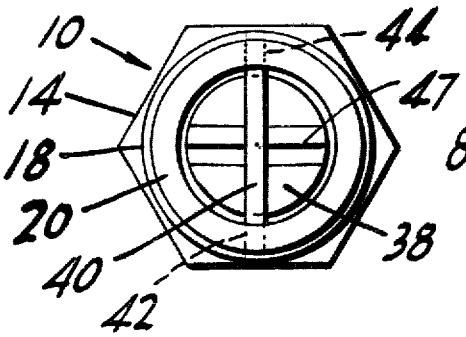
FIG. 3 is a bottom plan view of the switch of FIG. 1.

Now looking at FIG. 2, it is seen that the working parts of the switch within sleeve 12 include a switch element 22 having normally closed spring pressed electrical contacts 23, diagrammatically shown here in dotted lines. The switch is of well known conventional construction, preferably of the push-button type, one such as may be obtained from the manufacturer, Grayhill Inc. of 561 Hillgrove Avenue, LaGrange, Illinois 60525, and identified by their part No. 30-2. The switch is secured to a PVC washer 24 seated on a ledge 26 formed on the inner wall 28 of the sleeve and cemented thereto to seal it to the inner wall in fluid tight condition. Alternatively, the hollow portion of the sleeve above the washer 24, including the top portion of switch 22 may be encapsulated with a suitable sealing material to make it fluid tight.

Push-button 30 of switch 22 extends through a threaded extension 32 thereof and is enclosed in a fluid tight condition by a boot 33 formed of silicone rubber and secured to switch extension 32 by means of a nut 34 enclosed within and bonded to the boot, thus providing a fluid tight seal against the bottom of washer 24. Switch 22 is now sealed fluid tight relative to the hollow sleeve portion of the housing below washer 24, even though extending within this area. While other boots may be found satisfactory, it is preferred to use one such as manufactured by AMP-HEXSEAL, a division of AMP Corporation at 44 Honeck Street, Englewood, N. J. 07631, and identified by their part No. N5040-G.

Figure 7:
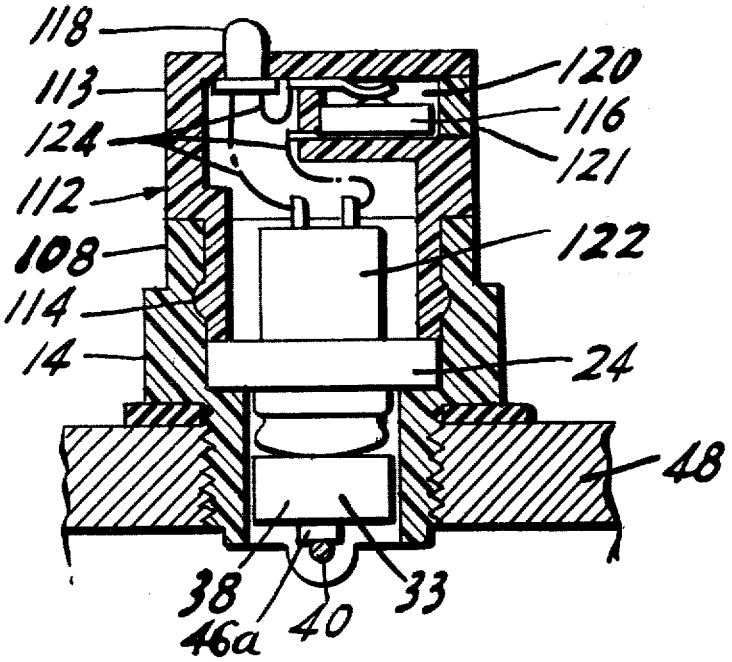
FIGS. 7, 8 and 9 are sectional views of still other modifications of the invention with some parts broken away and others in elevation.
Figure 9:
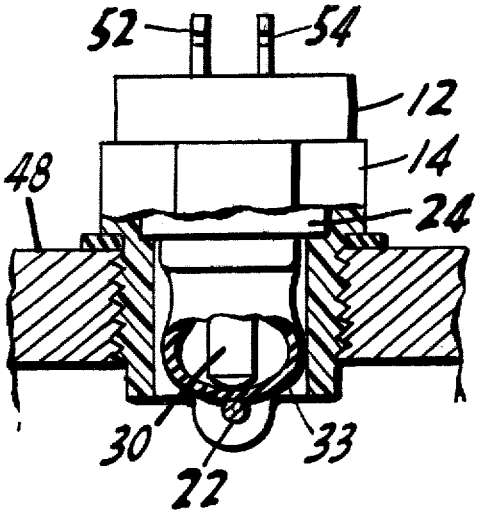

Push-button 30 is shown in its pushed or depressed condition holding the normally closed contacts within the switch 22 in open condition against the spring pressure normally holding them closed. In this preferred form of the invention, depression of the push-button is effected within boot 33 by a PVC plug 38 held in position by a metallic rod or wire element 40, the ends of which are retained in apertures 42 and 44 in opposite sides of sleeve portion 20. Plug 38 is provided with a V-shaped bottom 46 the lower edge 47 of which bears against the center of rod 40 whereby the total pressure of the spring within switch 22 is urged against the rod at that point. This pressure may be modified by increasing the area of contact of the plug against the rod, as shown in FIG. 7, more fully described later. As shown in FIG. 9 it will be understood that plug 38 could be eliminated by lengthening push-button 30 sufficiently for its end to engage rod 40, through boot 33 of course.

Figure 6:
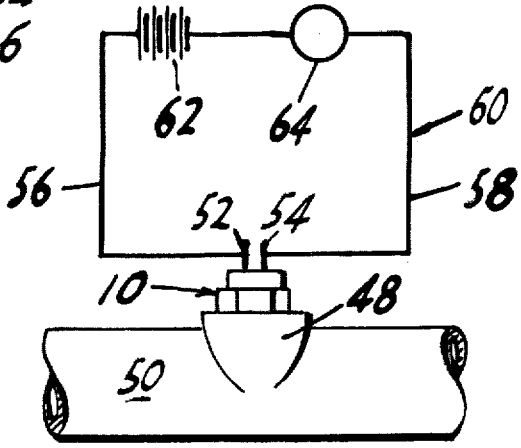
FIG. 6 is a view showing the switch mounted in a fluid flow system, shown only fragmentarily, with signal means in accordance with the invention to indicate a corrosive condition within the system when the switch is activated.

In its operation in fluid flow system, and as shown in FIG. 6, the switch assembly 10 is threaded into a boss 48 formed on a pipe conduit or passage 50 fragmentarily representing a portion of a fluid flow system. Leads 52 and 54 of switch 22 extend from the top of sleeve 12 and are connected to leads 56 and 58 respectively of the signal system 60 of the invention which includes a power source 62 and signal means 64. The power source may be a battery or other suitable means, while the signal means may be a light or some other visual means. Alternatively, it may be of an audible nature, bell, horn, buzzer etc. As more fully described hereinafter with referrence to FIG. 7, one of the modified forms of the invention, the signal system 60 may be combined as an integral part of the switch.

To facilitate a clear understanding of the invention, the following description will be with its use in solar heating system, where perhaps it will find its principal use, one such as manufactured by the Reynolds Metals Company at 6601 West Broad Street, Richmond, Virgina 23231, and which is described in their brochure identified "Adv. No. 790-1-4(3-778)". This system is charged with a fluid solution formulated to control internal corrosion of its fluid passages. The solution is primarily water to which is added a corrosion inhibitor, preferably such as is well known in the industry as NALCO 2755, four ounces to each gallon of water. In freezing areas a 50–50 solution of water and antifreeze, such as the well known PRESTONE II antifreeze, is used to prevent freezing of the solution. In this case six ounces of inhibitor is added for each gallon of water. Use of the inhibitor greatly reduces the rate of corrosion when only water is used in the system.

It is important to maintain the solution in a balanced condition as described above, and therefore, because of normal leakage, stagnation and evaporation in the system, the manufacturer recommends that the system be completely drained and recharged with fresh solution every few years. In the meantime between such draining and recharging, it is recommended that small amounts, perhaps two ounces, of inhibitor be added each year to maintain the recommended inhibitor concentration of the solution. In spite of these precautions a certain amount of corrosion is to be expected, approximately two mils per year according to the manufacturer.

Due to inattention or other oversight, sometimes these precautions are neglected permitting an undesired amount of corrosion to occur in the system. For example, if the inhibitor concentration weakens, increased corrosion will occur in the fluid passages, eventually, if not remedied, resulting in a complete breakdown of the system.

In the above described solar system, it is preferred that rod 40 be of aluminum, the same metal the manufacturer uses in the fluid passages. However, it should be understood that the invention is not to be considered so limited as other materials for the rod may be used in other systems.

With switch 10 mounted on boss 48, as shown in FIG. 6, rod 40 will be exposed to the fluid solution flowing through conduit 50. This exposure, if desired, may be facilitated by cutting away parts of the lower sleeve portion 20 between where the ends of the rod are attached, as shown in FIGS. 7 and 9. As corrosion occurs in conduit 50, rod 40, being of the same metal, will corrode at the same rate, eventually weakening the rod to an extent causing it to self-destruct thus permitting the force of the spring in switch 22 to bend the rod downwardly, or even sever it, by means of push-button 30 through boot 33 and plug 38. At the same time the switch spring will close the open contacts in the switch to actuate signal 64 through circuit 60. This will clearly indicate that an undesirable amount of corrosion is about to or has occured in the fluid passages and that remedial attention, such as by adding additional NALCO 2755 inhibitor, is called for to prevent further undesirable corrosion.

If an earlier indication of the corrosion taking place in the passages of the system is desired, the rod 40 may be of a material which corrodes at a faster rate than the passages. Then too, the time the rod self-destructs may be modified either way, faster or slower, by changing the thickness of the rod, thinner or thicker.

While the preferred form of the invention has been described, it will be understood that certain modifications thereof are possible without departing from the spirit thereof. In this regard, several such modifications are illustrated in FIGS. 4 through 9, by way of example, and will now be described.

Figure 4:
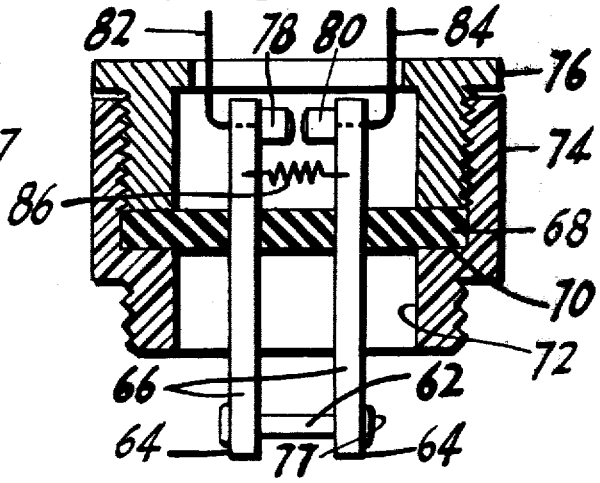
FIG. 4 is a sectional view similar to FIG. 2 but of a modification of the invention.

In FIG. 4, rod 62, corresponding to rod 40 in the above described preferred form of the invention, is attached to the lower end 64 of a pair of PVC rods 66. These rods extend upwardly through and are bonded in fluid tight relation to a non-corrosive resilient disc member 68 secured fluid tightly to a ledge 70 on the inner surface 72 of PVC housing 74 by means of a tubular member 76. This member is threaded into the housing with its lower edge bearing tightly against the outer edge of resilient disc 68. Rod 62 may be secured to the ends 64 of PVC rods 66 in any suitable manner, but are here shown as being peened or riveted over at its ends 77.

The upper end of rods 66 carry facing electrical contacts 78 and 80 for connection to leads 56 and 58 of circuit 60, as seen in FIG. 6, assuming that this form of the invention replaces switch 10 therein, and by way of leads 82 and 84. The upper ends of PVC rods 66 are biased toward each other by a tension spring 86 to bring its contacts 78 and 80 into contact with each other when rod 62 weakens by corrosion sufficiently to break under the tension of spring 86, thereby activating signal 64, as described above.

Figure 5:
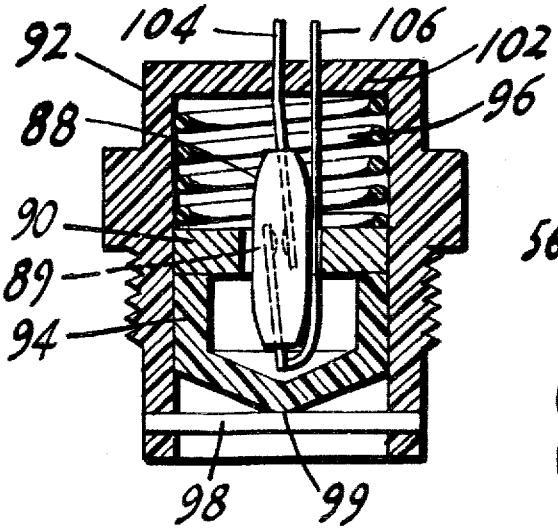
FIG. 5 is a view similar to FIG. 4 but of another modification.

The modification illustrated in FIG. 5 employs a normally closed reed switch 88 to activate signal 64. In this form of the invention the normally closed switch contacts 89 are biased to an held in their open condition by means of a washer like magnet 90 surrounding the switch and slidable within tubular PVC housing 92. Magnet 90 normally is held in its shown position between a hollow plug 94 also slidable in housing 92, and a spring 96, both of PVC material, by means of rod 98 secured to the lower end of tubular housing 92 similarly to rod 40 in FIG. 2. The upper end of spring 96 bears against the top wall 102 which closes that end of housing 92.

Plug 94 has a relatively sharp bottom edge 99 so that when rod 98 weakens as a result of corrosion, the pressure of spring 96 at that point will bend it downwardly, or sever it, thereby permitting spring 96 to move magnet 90 downwardly away from reed switch contacts 89. The contacts now will return to their closed condition and activate signal 64 in circuit 60, as described above, and to which it would be connected by leads 104 and 106 supporting the switch in housing 92.

The signal circuit 60, shown in FIG. 6, may be located remotely from switch 10, or the modifications thereof, or it may be assembled integrally therewith, as shown in FIG. 7. In this form of the invention the switch is similar to switch 10 described above, except that the top portion 108 of its PVC housing has been enlarged to accommodate the signal circuit designated generally in this figure by the numeral 112. The circuit elements are assembled in a housing 113 which is plugged into the top 108 of the switch and releasably held thereby by detent means 114. These elements comprise the battery 116 and a signal 118, such as a light emitting diode (LED). The battery is enclosed in a pocket 120 in the housing closed by a member 121. The battery is connected in circuit to the signal and the switch 122 by suitable leads 124. The leads connecting the switch 122 in circuit, shown here in broken lines, will be of sufficient length to permit their connection prior to pluggingh housing 113 into top portion 108. The remaining features of this modification are the same as in FIG. 2 except for that part of plug 38 which is in contact with rod 40. As mentioned heretofore, the plug bottom 46*a* has a larger area in contact with the rod, thus to modify the spring pressure against the rod. The other parts are identified by the same numerals as in FIG. 2.

Figure 8:
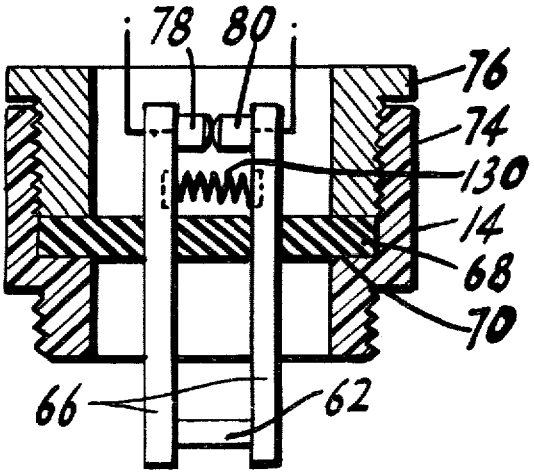

The modification illustrated in FIG. 8 is similar to that shown in FIG. 4. However, in this form of the invention, the contacts 78 and 80 are held in closed condition by rod 62, the ends of which are secured to the lower ends of PVC rods 66. Contacts 78 and 80 normally are biased away from each other by a compression spring 130 but are held together by rod 62. With this switch in the fluid flow system and connected in the signal circuit 60, FIG. 6, signal 64 will be continually activated until rod 62 is severed by corrosion, at which time contacts 78 and 80 are opened by spring 130. The need for remedial attention to the system to correct the corrosive condition therein will now be indicated by the absence of an optical or an audible signal.

As mentioned above, FIG. 9 illustrates the switch of the invention minus plug 38, and wherein the size of the push-button 30 and boot 33 of switch 22 have been increased permitting them to bear directly against the rod 22.

All of the modification described above may, of course, be provided with nut shaped portions, as shown at 14 in FIG. 1, to facilitate their mounting in a fluid flow system in place of the preferred form, as seen in FIG. 6.

From the above descriptions of the preferred and modified forms of the present invention, it will now be understood that it provides a novel and inexpensive corrosion indicator for detecting and indicating a corrosive condition within a fluid flow system whereby the need for remedial attention to the system to correct the condition is signalled.

I claim:

1. A corrosion indicator for use in a fluid flow system having metallic passages through which the fluid flows and wherein the fluid comprises a balanced solution of water and an inhibitor to retard corrosion in the system, water being the primary fluid in the solution, said corrosion indicator comprising: switch means having electrical contacts for connection to signal means;

means including a metallic component normally holding said contacts in one of two conditions, open or closed, but including means for moving said contacts to the other of said two conditions;

a housing for said switch means having means for connection thereof into a fluid flow system; and means on said housing maintaining said switch means against contact with the fluid solution when said housing is mounted in a fluid flow system;

said metallic component in said second mentioned means being exposed for contact with said fluid solution when said housing is mounted in a fluid flow system and subject to an undesirable amount of corrosion which may occur in the system as a result of an imbalance occuring in the fluid solution to self-destruct by corrosion after a period of time permitting the contacts to be returned to the other of said two conditions thereby to actuate signal means to indicate the undesirable corrosive condition in the system.

2. A corrosion indicator according to claim 1 wherein: said metallic component in said second mentioned means comprises a metallic rod, said switch is of the push-button type, and said means maintaining said switch against contact with the fluid solution comprises a non-corrosive member on which said switch is mounted; and further comprises means sealing said non-corrosive member to the surrounding housing walls; and a non-corrosive flexible boot member enclosing the push-button of said push-button switch and sealed against said non-corrosive member upon which said push-button switch is mounted; and wherein the said push-button and said boot are urged against said metallic rod by the means normally holding said contacts in one of their two conditions.

3. A construction according to claim 2 and further comprising;

a non-corrosive member slidably mounted in said housing interposed between said boot and said rod and having a portion thereof urged against said metallic rod by said push-button.

4. A corrosion indicator according to claim 1 wherein:

said housing is formed of tubular non-corrosive material and is divided into two compartments by a flexible non-corrosive member; and said electrical contacts are mounted on non-corrosive rods extending through said flexible member with said contacts in one of said compartments and said last means is mounted between said non-corrosive rods in the other compartment.

5. In a fluid flow system having metallic passages through which the fluid flows and wherein the major portion of the fluid is water to which a corrosion inhibitor has been added in solution to prevent an undesirable amount of corrosion in the said passages and wherein an undesirable amount of such corrosion may occur as a result of a deterioration occuring in the solution by depletion of the corrosion inhibitor in the solution as it is flowing through the system: said system comprising:

signal means;

means in said system including a metallic component of the same metal as the said passages and subject to an undesirable amount of corrosive action to self-destruct by reason of such corrosion as a result of a deterioration of the said corrosion inhibitor in said fluid solution as it flows through the passages; and means responsive to the self-destruction of said metallic component to actuate said signal means thereby to indicate the undesirable corrosive condition in said system.

6. A corrosion indicator according to claim 5 and further comprising:

a tubular non-corrosive housing; and a non-corrosive element dividing said housing into two compartments; and wherein said first and third mentioned means are positioned in one of said compartments out of contact with said fluid as it flows through said system; and said second mentioned means is positioned in the other of said compartments for exposure to the fluid as it flows through said system.

* * * * *